US006128176A

United States Patent [19]

Radichio

[11] Patent Number: 6,128,176

[45] Date of Patent: Oct. 3, 2000

[54] EXTERNAL BURNER SHUT-OFF

[76] Inventor: Arthur Radichio, 89 Gate La., Levittown, N.Y. 11756

[21] Appl. No.: 09/162,290

[22] Filed: Sep. 29, 1998

[51] Int. Cl.[7] ..... F23N 5/24

[52] U.S. Cl. ..... 361/160; 431/73; 307/140

[58] Field of Search ..... 431/29, 72, 73, 431/86; 361/160, 194; 307/139–143

[56] References Cited

U.S. PATENT DOCUMENTS 3,976,421 8/1976 Lee et al. ..... 431/29
4,610,294 9/1986 Anesi et al. ..... 307/141

*Primary Examiner*—Fritz Fleming
*Attorney, Agent, or Firm*—Nolte, Nolte & Hunter

[57] ABSTRACT

The present invention provides an external burner shut-off for oil fired heating systems. More specifically, the present invention provides a burner control circuit interrupt for a burner control circuit. The interrupt includes a pair of switches controlled by a relay coil. One of the switches opens the power supply to the burner control circuit and the other switch provides power to a timer circuit of the interrupt. The timer circuit counts down from a predetermined time to allow sludge in an oil holding tank to resettle after an oil delivery. The interrupt provides a fail-safe feature to insure that the burner control circuit is not inadvertently interrupted.

19 Claims, 4 Drawing Sheets

EXTERNAL BURNER SHUT-OFF

FIELD OF THE INVENTION

The present invention relates to a control circuit interrupt. More particularly, the present invention relates to a control circuit interrupt for an oil fired heating system including a fail-safe feature.

BACKGROUND OF THE INVENTION

Oil fired heating systems typically incorporate a primary burner control that controls the ignition and the supply of oil to the system burner. The primary burner control, in response to a signal from an aquastat or air thermostat, will activate the burner and supply oil to the burner. When the system reaches the desired temperature, the burner will shut off.

A common problem with oil fired heating systems is that over time sludge accumulates and settles to the bottom of the oil tank. Because the sludge settles below the pickup line, it does not typically create problems during regular operation of the heating system. However, during an oil delivery the sludge gets churned up when oil is added to the heating tank. If the burner control actives and supplies oil from the holding tank to the burner, the sludge will be drawn into the pickup tube to the burner. While the pickup line or burner usually includes a filter, this filter is only intended to prevent microparticles from reaching the burner. A significant amount of the sludge will clog the filter and prevent the fuel from reaching the burner, the burner flame will be extinguished and the system will shut down until the filter is cleaned or replaced.

A way to prevent clogging of the filter is to inhibit operation of the heating system during and directly after an oil delivery for a time sufficient to allow any sludge present in the holding tank to settle back down to the bottom of the tank.

U.S. Pat. No. 3,976,421 to Lee et al. discloses a sediment control apparatus as described above. The apparatus has an internal interrupt timer that incorporates a normally closed switch into the burner control circuit. The system also includes an initiation switch, connected to the timer, that an oil delivery person activates to start the interrupt timer. When the initiation switch is activated, the timer opens the normally closed switch to interrupt the control circuit.

A disadvantage of this device, however, is that the timer is integrated with and receives power from the same power supply as the burner control circuit. If the timer fails, for whatever reason, after being activated the normally closed switch will remain open. That will prevent operation of the heating system even after the elapsed interrupt period has passed, and the home will be without heat until the timer circuit can be repaired.

SUMMARY OF THE INVENTION

The present invention provides a mechanism to interrupt a burner control circuit for a predetermined period of time, and includes a fail-safe feature to prevent unwarranted interruption of the control circuit.

The present invention provides a burner control circuit interrupt including a relay coil, a normally closed relay switch controlled by the relay coil, a normally open timer switch, and a timer that controls the normally open timer switch.

The present invention provides a burner control circuit interrupt including a control circuit connection port, a power supply connection port and a normally open initiate switch, wherein the normally closed relay switch is connected across the control circuit connection port and the initiate switch couples the timer and the power supply connection port.

DESCRIPTION OF THE DRAWINGS

For the purpose of illustrating the invention, the drawings show a form of the invention. This invention, however, is not limited to the precise arrangements and instrumentalities shown in the drawings. The present invention is described in the context of an oil burner control circuit interrupt, however, the present invention may be used in conjunction with any similar circuit.

DESCRIPTION OF THE INVENTION

Figure 1:
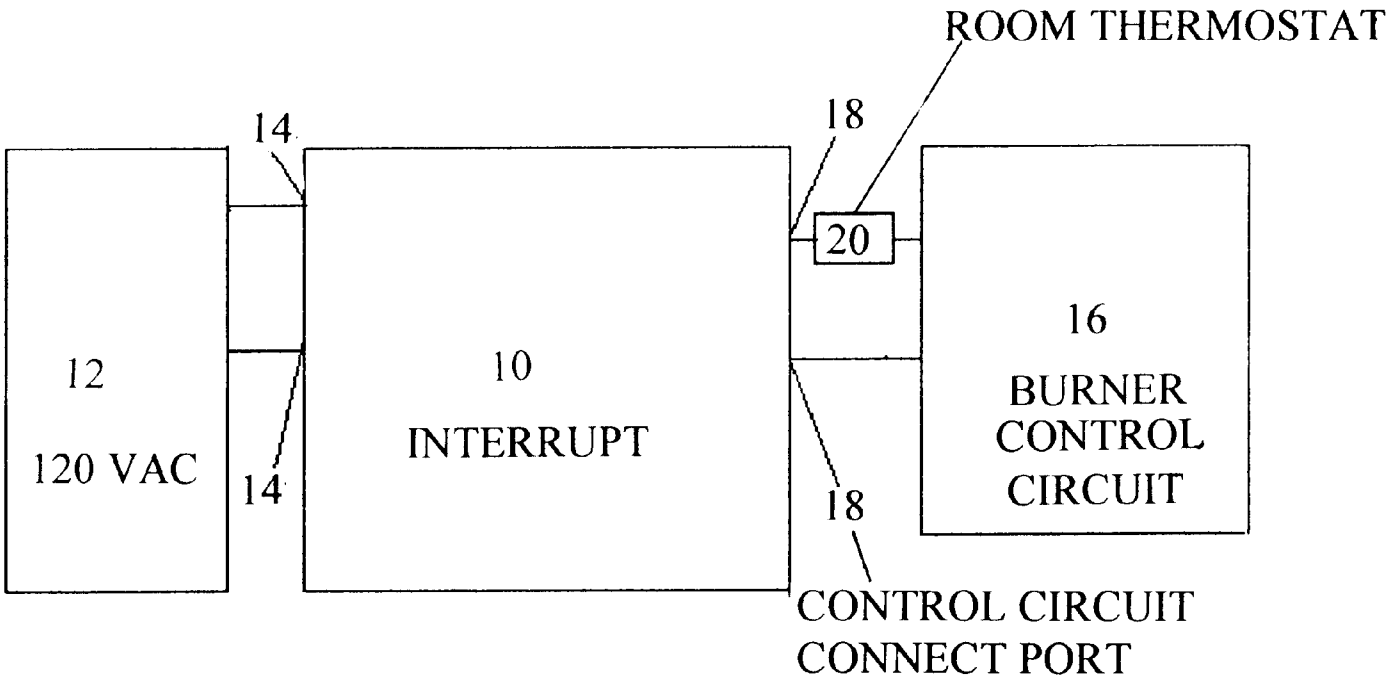
FIG. 1 is a block diagram illustrating the present invention connected to a control circuit.

In the drawings, where like numerals identify like elements, a control circuit interrupt of the present invention is generally designated by the numeral 10.

As illustrated in FIG. 1, the interrupt 10 is connected to a power supply 12 at a power supply connection port 14. The interrupt 10 is connected to a control circuit 16 at a control circuit connection port such as burner control connection port 18. When used with a hot air system, a temperature sensor or room thermostat 20 is connected between the control circuit 16 and interrupt 10. Typically, the temperature sensor 20 will include a normally open switch. The switch will close when the sensor 20 achieves the preselected temperature thereby supplying power to the oil burner supply pump. If, however, the control circuit 16 is for a hot water system then the sensor 20 will not be present.

Figure 2:
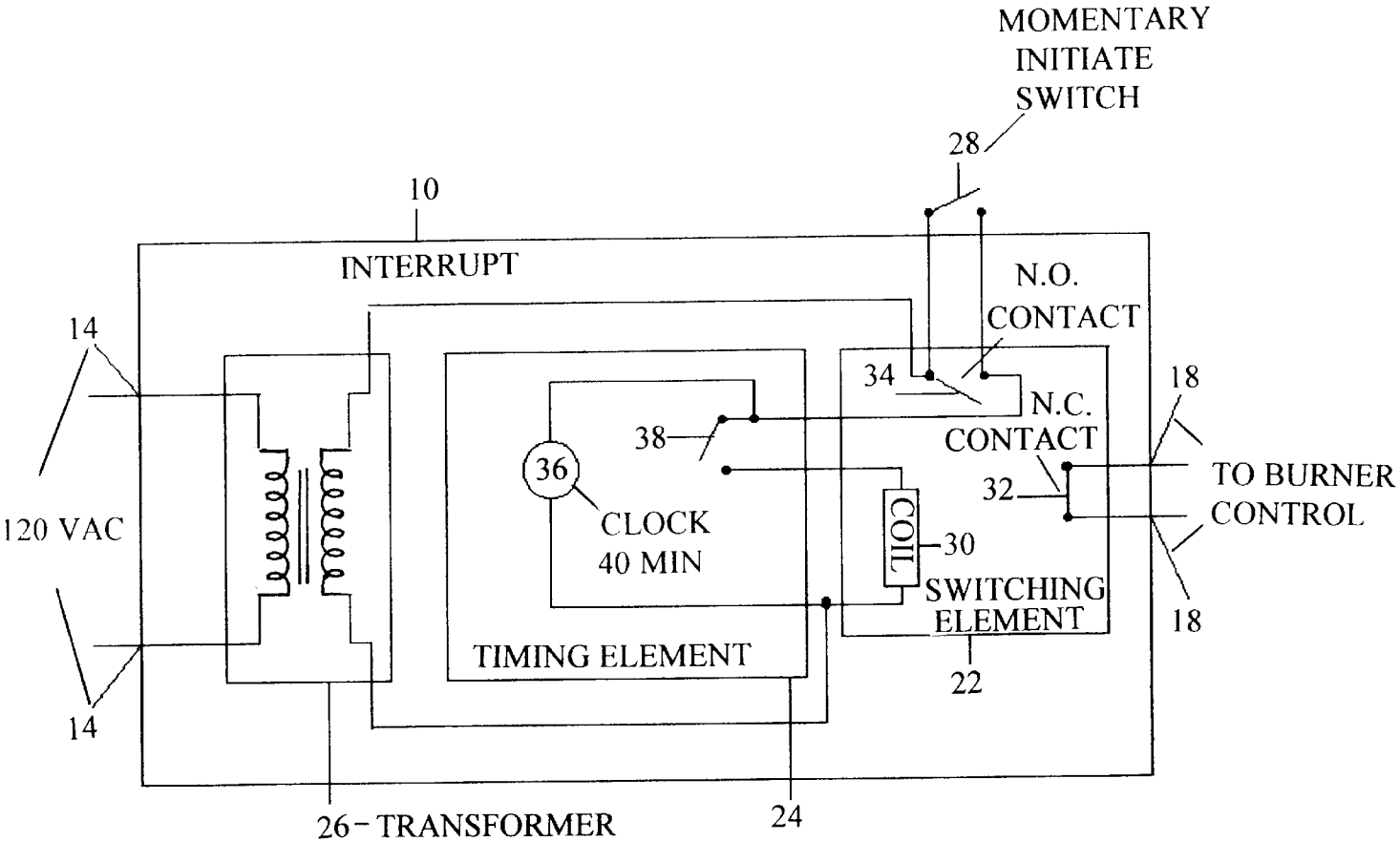
FIG. 2 is a circuit diagram of an embodiment of the present invention.

The interrupt 10, as shown in more detail in FIG. 2, includes a switching element 22 and a timing element 24. The interrupt 10 may also include its own transformer 26 for converting line voltage to low voltage to operate the interrupt components. In this embodiment, the transformer 26 is connected across the power supply connection port 14. The interrupt 10 also includes an initiate switch 28. The initiate switch 28 provides a connection between the timing element 24 and the power supply. As illustrated in FIG. 2, the initiate switch 28 is connected to the transformer 26.

In its steady state, the initiate switch 28 provides an open circuit between timing element 24 and the transformer 26. The initiate switch 28 may be any type of switch that provides a momentary connection between the transformer 26 and the timing element 24, for example, a spring loaded toggle switch.

The switching element 22 includes a relay coil 30. The relay coil 30 controls a normally closed relay switch 32 and a normally open relay switch 34. The term "normally" is determined as the state when the interrupt 10 is inactive and is not operating to interrupt the control circuit 16.

The normally closed relay switch 32 is connected across the control circuit connection port 18 providing a short circuit across the port 18 allowing the control circuit 16 and the sensor 20 to operate according to their defined parameters. The normally open relay switch 34 is connected to the transformer 26 at one lead and to the timing element 24 at the other lead. When the relay coil 30 is energized the normally closed relay switch 32 is forced open and the normally open relay switch 34 is forced closed.

The timing element 24 includes a clock 36 and a normally open timed switch 38 controlled by the clock 36. The timing element 34 is individually coupled to the transformer 26 through both the initiate switch 28 and normally open relay switch 34. Furthermore, both the clock 36 and the timed switch 38 are coupled to the transformer 26 separately through the initiate switch 28 and the normally open relay switch 34. The normally open timed switch 38 is also connected to the relay coil 30. The clock 36 is preset to a specified delay period, for example 20–40 minutes, that would allow any sludge that is stirred by an oil delivery to settle back to the bottom of the oil holding tank during the preset delay period. The timing element 24 closes the normally open timed switch 38 upon receiving power from the power supply.

Once the control circuit interrupt 10, as illustrated in FIG. 2 is connected to a power supply 12 and a control circuit 16 it operates in the following manner. Upon delivering an oil shipment, the delivery person activates the initiate switch 28 thereby closing the switch 28. When the initiate switch 28 is activated the timing element 24 is connected to the power supply, thereby providing power to the timing element 24. Once the timing element 24 receives power, the clock 36 begins to run and the timed switch 38 closes. Once the timed switch 38 closes, the relay coil 30 receives power and is energized. Once the relay coil 30 is energized and while the initiate switch 28 is still closed, the relay coil 30 opens the normally closed relay switch 32 and closes the normally open relay switch 34. The relay coil 30 has been energized and changes the state of the relay switch 32,34 by the time the initiate switch 28 springs back open. With the normally open relay switch 34 closed, the timing element 24 now receives power through the relay switch 34 and the relay coil 30 now receives power through the relay switch 34 and the timed switch 38.

As long as the relay coil 30 is energized and the relay switch 32 is open, the control circuit 16 will be prevented from activating the burner or burner supply.

Once the clock 36 counts through the preset time period, the timing element 34 will open the timed switch 38. Once the timed switch 38 is open, power to the relay coil 30 will be cut and the relay coil 30 will de-energize.

Once the relay coil 30 de-energizes, the relay switches 32,34 will return to their normal states. Once the normally closed relay switch 32 closes, the control circuit 16 will again be able to operate.

The design of the interrupt 10 of the present invention provides a highly desirable fail-safe feature. As described above, the timed switch 38 is normally open and will only close under direction and control of the timing element 24. Furthermore, the timed switch 38 must be closed in order for the relay coil 30 to receive power which in turn opens relay switch 32. If for any reason the timing element 24 fails, the timed switch 38 will open and consequently de-energize the relay coil 30 and thereby closing the relay switch 32. If this feature were not present and the timed switch 38 were not to open upon failure of the timing element 24 then the relay coil 30 would remain energized and the relay switch 32 would remain open. This would prevent operation of the control circuit 16 well after the oil delivery had been completed. By including such a fail-safe feature, the present invention overcomes one of the drawbacks of conventional systems.

Figure 3:
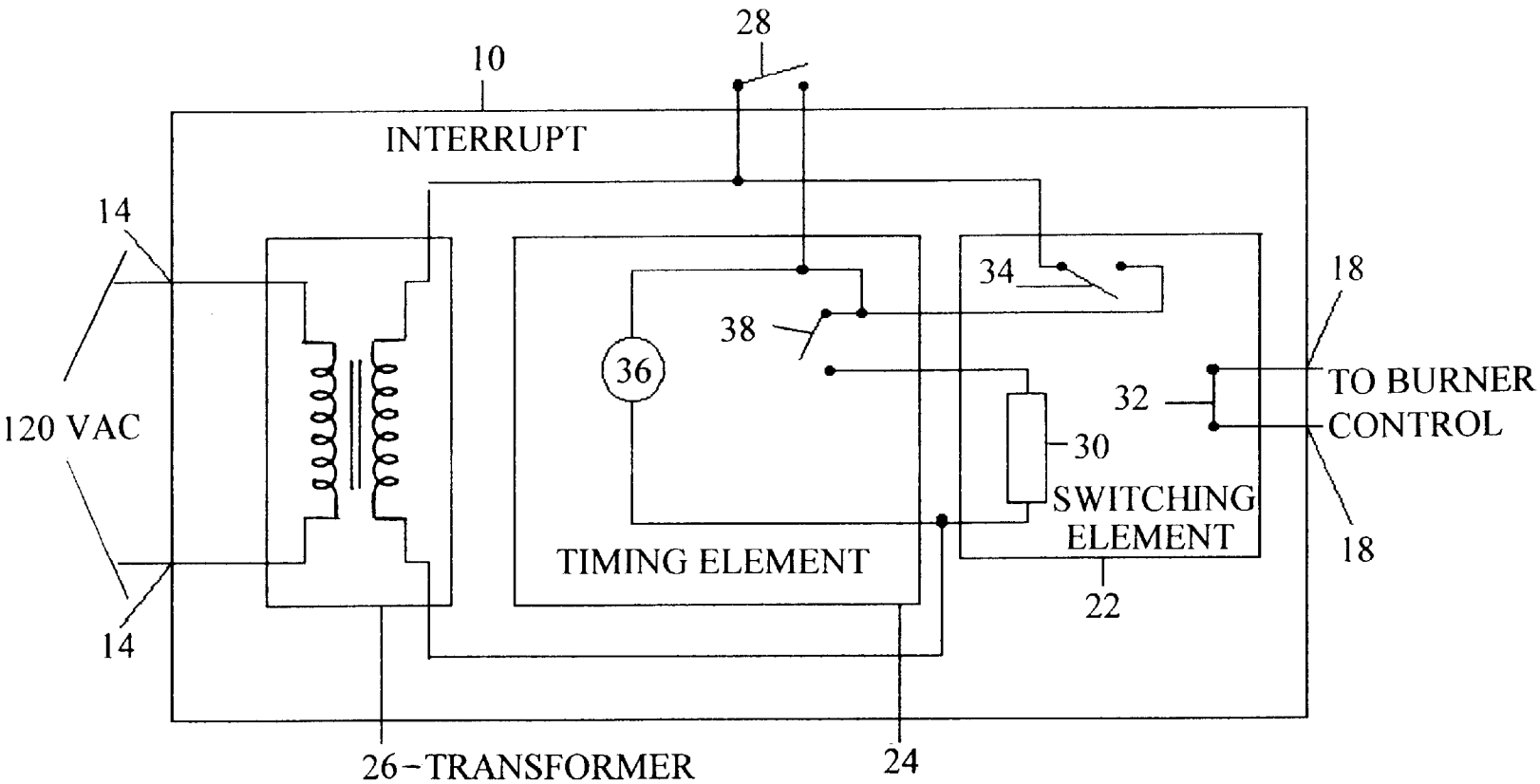
FIG. 3 is a circuit diagram of an alternate embodiment of the present invention.

In an alternate embodiment, illustrated in FIG. 3, the initiate switch 28 is not positioned in parallel with the normally open relay switch 34. Instead, the initiate switch 28 is connected directly between the transformer 26 and the timing element 36.

Figure 4:
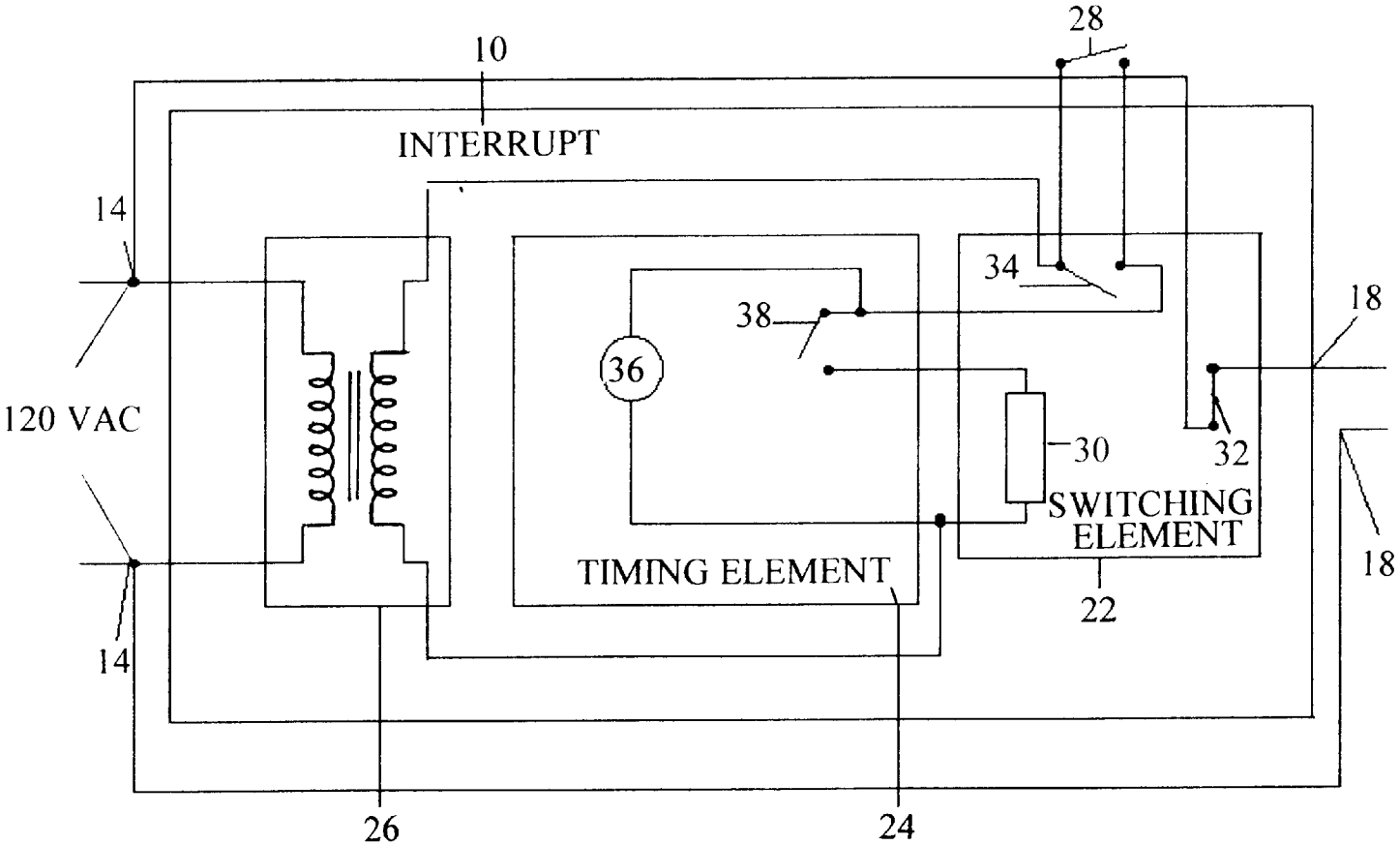
FIG. 4 is a circuit diagram of another alternate embodiment of the present invention.

FIG. 4 presents another alternate embodiment of the present invention. In this embodiment, power is supplied to the control circuit 16 through the interrupt 10. The normally closed relay switch 32 couples the control circuit 16 to the power supply (not shown). When the relay coil 30 is energized, the normally closed relay switch 32 opens and the normally open relay switch 34 closes. When the relay switch 32 opens, power is cut to the control circuit 16. As long as the relay coil 30 is energized the control circuit 16 will be inoperative.

The present invention may be embodied in other specific forms without departing from the spirit or essential attributes thereof and, accordingly, reference should be made to the appended claims, rather than to the foregoing specification, as indicating the scope of the invention.

What is claimed is:

1. A heating system burner control circuit interrupt, comprising:

a burner control circuit connection port;

a power supply connection port;

a switching element including a normally closed relay switch connected across the burner control circuit connection port, a normally open relay switch, and a relay coil;

a timer circuit including (a) a normally open timed switch coupling the normally open relay switch and the relay coil and (b) a timer element connected to the timed switch; and a normally open initiate switch coupling the power supply connection port and the timer circuit.

2. A burner control circuit interrupt as recited in claim 1, wherein the timer element includes a countdown clock set for a preselected period of time.

3. A burner control circuit interrupt as recited in claim 1, further comprising a power supply coupled to the power supply connection port.

4. A burner control circuit interrupt as recited in claim 3, wherein upon activation of the initiation switch the timer circuit receives power from the power supply which closes the timed switch and initiates the countdown clock.

5. A burner control circuit interrupt as recited in claim 4, wherein upon closure of the timed switch the relay coil receives power from the power supply which in turn opens the normally closed relay switch and closes the normally open relay switch.

6. A burner control circuit interrupt as recited in claim 1, wherein the normally open relay switch couples the power supply connection port and the normally open timed switch.

7. A burner control circuit interrupt as recited in claim 1, wherein upon activation of the initiation switch the timer circuit is connected to the power supply connection port.

8. A burner control circuit interrupt as recited in claim 1, wherein closure of the timed switch connects the relay coil to the power supply connection port.

9. A burner control circuit interrupt as recited in claim 1, wherein energizing the relay coil causes the normally closed relay switch to open and the normally open relay switch to close.

10. A heating system burner control circuit interrupt, for a heating system burner control circuit, said heating system burner control circuit interrupt comprising:

a switching element including:

a normally closed relay switch for normally enabling the heating system burner control circuit, and for interrupting the heating system burner control circuit;

a normally open relay switch; and a relay coil such that both switches are controlled by the relay coil; and a timer circuit including:

(a) a normally open timer switch coupling the normally open relay switch and the relay coil, and (b) a timing element associated with the timer switch.

11. A burner control circuit interrupt as recited in claim 10, further comprising a power supply port and an initiation switch wherein activation of the initiation switch connects the timer circuit to the power supply port.

12. A burner control circuit interrupt as recited in claim 11, wherein closure of the timer switch connects the relay coil to the power supply port.

13. A burner control circuit interrupt as recited in claim 12, wherein the normally open relay switch couples the power supply port and the timer switch.

14. A burner control circuit interrupt as recited in claim 13, wherein energizing the relay coil causes the normally closed relay switch to open and the normally closed relay switch to open.

15. A heating system burner control circuit interrupt, comprising:

a burner control circuit connection port;

a power supply port;

an initiation switch connected to the power supply port;

a switching element including a normally open switch for providing power to the interrupt, a normally closed switch connected across the burner control circuit connection port, and a relay coil that controls the normally open switch and the normally closed switch whereupon a change of state of said relay coil opens the normally closed switch establishing an open circuit across the burner control circuit connection port and closes the normally open switch connecting the relay coil to the power supply port;

a timer element connected to the initiation switch whereupon activation of the initiation switch couples the timer element to the power supply port, the timer element including a timer switch that provides a connection for the relay coil to the power supply port and a timer that controls the timer switch thereby controlling the state of the relay coil.

16. A burner control circuit interrupt as recited in claim 15, wherein the timer element further comprises a clock set for a predetermined period of time.

17. A heating system burner control circuit interrupt, for interrupting a heating system burner control circuit, said heating system burner control circuit interrupt comprising:

a switching element including a relay coil and a normally closed relay switch for connecting across the heating system burner control circuit; and a timer element connected to the switching element whereupon energizing the relay coil opens the normally closed switch;

a power supply port and an initiation switch coupling the timer element and the power supply port;

wherein the timer element further comprises a normally open timer switch connected to the relay coil.

18. A burner control circuit interrupt as recited in claim 17, wherein the timer element further comprises a clock set for a predetermined period of time that controls the timer switch.

19. A burner control circuit interrupt as recited in claim 18, wherein closure of the timer switch connects the relay coil to the power supply port.

* * * * *